US007559630B2

(12) United States Patent
Bell et al.

(10) Patent No.: US 7,559,630 B2
(45) Date of Patent: Jul. 14, 2009

(54) SUBSTANTIALLY PLANAR FLUID EJECTION ACTUATORS AND METHODS RELATED THERETO

(75) Inventors: Byron Vencent Bell, Paris, KY (US); Burton Lee Joyner, II, Lexington, KY (US); Jessica Laurel Mayes, Paris, KY (US)

(73) Assignee: Lexmark International, Inc., Lexington, KY (US)

( * ) Notice: Subject to any disclaimer, the term of this patent is extended or adjusted under 35 U.S.C. 154(b) by 187 days.

(21) Appl. No.: 11/277,161

(22) Filed: Mar. 22, 2006

(65) Prior Publication Data

US 2007/0222824 A1 Sep. 27, 2007

(51) Int. Cl.
*B41J 2/05* (2006.01)

(52) U.S. Cl. ..... 347/63; 347/61; 347/54; 347/56; 347/44

(58) Field of Classification Search ..... 347/44, 347/45, 54–56, 61–63
See application file for complete search history.

(56) References Cited

U.S. PATENT DOCUMENTS

| | | | | |
|---|---|---|---|---|
| 4,535,343 | A | 8/1985 | Wright et al. | |
| 5,861,902 | A | 1/1999 | Beerling | |
| 6,386,685 | B1 * | 5/2002 | Sugioka | 347/61 |
| 6,767,474 | B2 | 7/2004 | Trieba et al. | |
| 6,785,956 | B2 | 9/2004 | Xu et al. | |
| 2003/0170567 | A1 * | 9/2003 | Patil et al. | 430/280.1 |
| 2005/0174390 | A1 * | 8/2005 | Sun et al. | 347/63 |

FOREIGN PATENT DOCUMENTS

| | | |
|---|---|---|
| EP | 649 748 | 4/1995 |

OTHER PUBLICATIONS

D. Crouse et al., Self-Ordered Pore Structure of Anodized Aluminum on Silicon and Pattern Transfer, Applied Physics Letters, vol. 76, No. 1, pp. 49-51 (2000).
B. Das et al., Novel Template-Based Semiconductor Nanostructures and Their Applications, Appl. Phys. A 71, 681-688 (2000).
S. Ono et al., Effects of Current Density and Temperature on the Morphology and Electric Properties of Anodic Films on Aluminum, Electrochemical Society Proceedings, vol. 2001.
99.5 % Alumina, thin film substrate, Mat Web, copyright 1996-2006, http://www.matweb.com/search/specificMaterialPrint.asp?bassnom=BA9A, Automatic Creation, Inc. (printed on Apr. 13, 2006).

* cited by examiner

*Primary Examiner*—K. Feggins
*Assistant Examiner*—Henok Legesse
(74) *Attorney, Agent, or Firm*—Luedeka, Neely & Graham pc

(57) ABSTRACT

Fluid ejection actuators, micro-fluid ejection heads, and methods relating thereto. One such fluid ejection actuator is provided by a conductive layer adjacent a substrate. The conductive layer has a substantially non-conductive portion. The substantially non-conductive portion includes a portion of the conductive layer which has been treated to have low conductivity properties. A resistive layer is adjacent the conductive layer. The substantially non-conductive portion of the conductive layer substantially defines the fluid ejection actuator.

10 Claims, 3 Drawing Sheets

SUBSTANTIALLY PLANAR FLUID EJECTION ACTUATORS AND METHODS RELATED THERETO

FIELD OF THE DISCLOSURE

The present disclosure is generally directed to an improved micro-fluid ejection device. More particularly, the disclosure is directed toward, for example, an improved manufacturing process and structure for resistive fluid ejection actuators which avoids the formation of non-planar topographies.

BACKGROUND AND SUMMARY

A micro-fluid ejection device such as a thermal ink jet printer, forms an image on a printing surface by ejecting small droplets of ink from an array of nozzles on an ink jet printhead as the printhead traverses the print medium (for scanning type printheads). The fluid droplets are expelled from a conventional thermal micro-fluid ejection head when a pulse of electrical current flows through the fluid ejection actuator, which is a resistive fluid ejection actuator, vaporizing a small portion of the fluid to create a bubble that expels such a drop(s) from a nozzle positioned above the resistive fluid ejection actuator. Typically, there is one resistive fluid ejection actuator corresponding to each nozzle of a nozzle array on the ejection head. The resistive fluid ejection actuators are activated under the control of a microprocessor in the controller of the micro-fluid ejection device.

Resistive fluid ejection actuators are prone to mechanical damage from cavitation as the bubble collapses after drop ejection. Any non planar topography near the actuator pad, particularly at the edges of the pad where conductor lines may terminate, can act as a stress riser for conformal overcoats or films that are applied to protect the actuator pad. Non-planar topographies can also cause non-homogenities in any overcoats or films. Such non-homogenities may also result from the thermal gradient between the relatively hot center of the resistive actuator pad and the relatively cool edges.

With reference to FIG. 1, there is shown a conventional structure 10 for a resistive fluid ejection actuator, in the form of a resistive heater, for a micro-fluid ejection head. In this structure 10, there is provided a substrate 12 having a thermal barrier 13 having a resistive layer 14 deposited thereon. The resistive layer 14 is in electrical contact with a conductor layer 16. The conductor layer 16 is etched to create a heater pad area 18 between conductive portions 16A and 16B. As the conductor layer 16 is relatively thick (e.g., about 5000 Angstroms), a subsequent dielectric layer 20 and cavitation layer 22 must step up at the edges of the heater pad area 18 to cover and seal exposed portions of the conductive portions 16A and 16B. This step up results in a non-planar structure as shown. Additional layers, such as an insulating layer 24 and a passivation layer 26 are conventionally included to complete the heater structure 10.

The mechanical, cavitational, thermal, and other stresses associated with this conventional non-planar structure 10 can collectively result in weak areas in the film or overcoat layers 20-26 that are prone to fracture, causing pre-mature failure of the actuator. As the overcoats and films become thinner, such as in an effort to increase thermal efficiency, the likelihood of such weak areas in such layers increases.

The foregoing and other needs may be provided for by a fluid ejection actuator that is provided by a conductive layer adjacent a substrate. The conductive layer has a substantially nonconductive portion. The substantially non-conductive portion includes a portion of the conductive layer that has been treated to have low conductivity properties. A resistive layer is adjacent the conductive layer. The substantially non-conductive portion of the conductive layer substantially defines the fluid ejection actuator. Such an actuator might be particularly suitable for use as a micro-fluid ejection head.

In another one of the embodiments, the disclosure relates to a method for manufacture of a resistive fluid ejection actuator. In one such method, a conductive layer is applied adjacent a substrate. A mask is applied over the conductive layer and developed to expose a selected portion of the conductive layer. The exposed selected portion of the conductive layer is treated to transform the selected portion into a portion having low conductivity properties to provide a substantially non-conductive portion. The mask is removed. A resistive layer is applied adjacent the conductive layer to provide a fluid ejection actuator. Still further embodiments exist.

The embodiments described herein improve upon the prior art in a number of respects. For example, at least some of the embodiments lend themselves to a variety of applications in the field of micro-fluid ejection devices, and particularly in regards to inkjet printheads having improved longevity and less susceptibility to mechanical failure. Another advantage of at least some of the embodiments described herein is that thinner protective layers may be used that may be effective to increase the energy efficiency of the fluid ejector actuators.

BRIEF DESCRIPTION OF THE DRAWINGS

Further advantages of exemplary embodiments disclosed herein may become apparent by reference to the detailed description of exemplary embodiments when considered in conjunction with the drawings, which are not to scale, wherein like reference characters designate like or similar elements throughout the several drawings as follows.

DETAILED DESCRIPTION OF EXEMPLARY EMBODIMENTS

Figure 1:
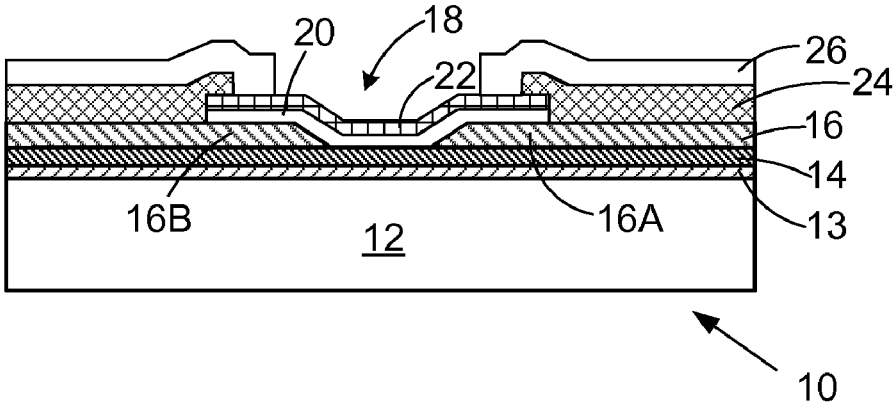
FIG. 1 Prior Art
FIG. 1 is a representational cross-sectional view, not to scale, of a conventional resistive fluid ejection actuator structure having non-planar topographies.
Figure 2:
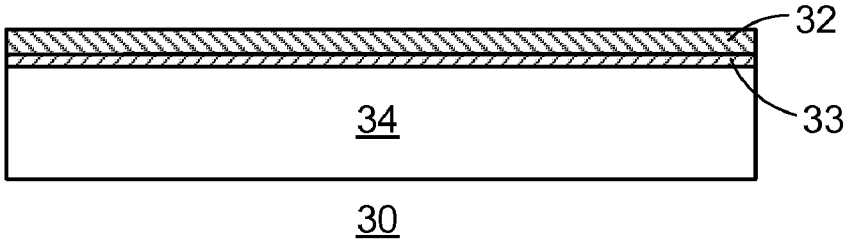
FIGS. 2-6 show steps in the manufacture of a micro-fluid ejection head structure having a substantially planar resistive fluid ejection actuator configuration according to one embodiment of the disclosure.
Figure 3:
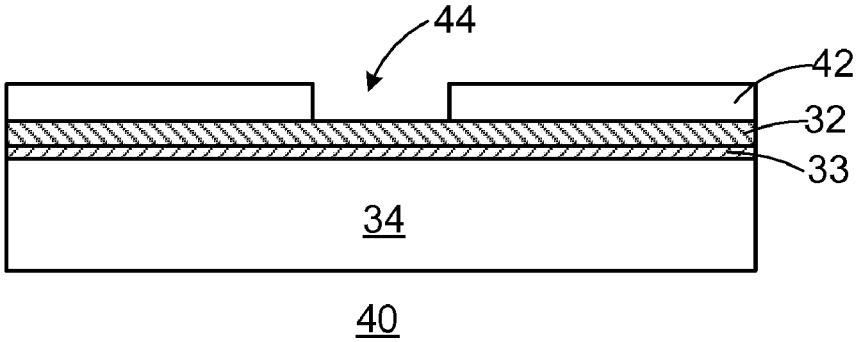
Figure 4A:
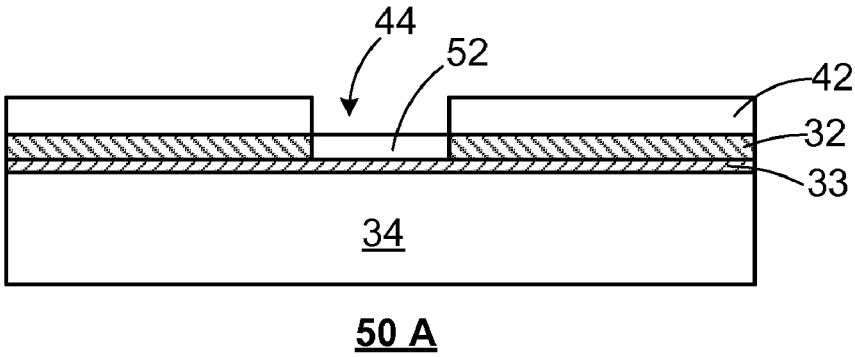
Figure 4B:
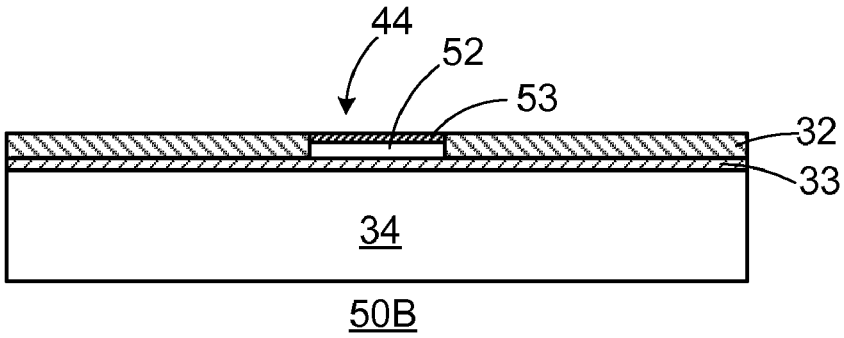

Referring now to FIGS. 2-6, there are shown steps in the manufacture of a micro-fluid ejection head having a substantially planar resistive fluid ejection actuator structure according to the disclosure. In the manufacturing steps, a conductive layer is treated to yield a first portion thereof that is highly resistive and second portions to serve as anode and cathode conductors for a micro-fluid ejection actuator. Since conventional etching steps to remove conductive material are eliminated in the exemplary embodiments described herein, non-planar topographies yielded by such etching steps are avoided.

For example, in step 30 (FIG. 2), a conductive layer 32 may be deposited adjacent (e.g., on) a substrate 34. The conductive layer 32 may be, for example, an aluminum film or layer having a conductivity of at least about 50 μOhm-cm at 500° C. The substrate 34 may be selected from, for example, silicon substrates and/or ceramic substrates, or other substrates suitable for use in providing micro-fluid ejection heads. If desired, the substrate 34 may include a thermal barrier 33, such as an oxide barrier layer deposited or grown adjacent the substrate 34. The substrate 34, including the barrier layer 33, typically has a thickness ranging from about 200 to about 800 microns.

In step 40 (FIG. 3) a mask layer 42 is applied onto the conductive layer 32 and the mask layer 42 is developed to expose a desired portion 44 of the conductive layer 32 intended to serve as an insulator under a resistive fluid ejection actuator. In generals portion 44 will serve to substantially define the area of a resistor layer that will comprise the actuator. The mask layer 42 may, for example, be a photoresist or other patterned material that is applied by conventional coating techniques such as roll coating, blade coating, spin coating, and the like, and is developed using conventional developing techniques to provide the desired exposed portion 44. The mask layer 42 may also consist of a hard mask formed by deposition of a solid layer, such as SiN, $SiO_2$, SiON or the likes which is patterned and etched by conventional semiconductor methods to provide the desired exposed portion 44.

In step 50 (FIG. 4A), the exposed portion 44 of the conductive layer 32 is treated to transform the exposed portion 44 of the conductive layer 32 to a portion having low conductivity (or high resistive) properties, thereby providing a substantially non-conductive portion 52. In this regard, "low conductivity (or high resistive) properties" will be understood to mean that the substantially non-conductive portion 52 has a resistivity of at least about 5000 μOhm-cm at 5000° C. Thus, it will be understood that the exposed portion 44 is treated to change the exposed portion 44 from having substantially conductive properties to having substantially non-conductive properties sufficient to provide individual anode and cathodes segments 32A and 32B in the conductive layer 32 without the need to etch the conductive layer 32. Since the conductive layer 32 is not etched by the process described herein, overcoat layers applied to the conductive layer 32, if any, may be substantially planar.

Figure 5:
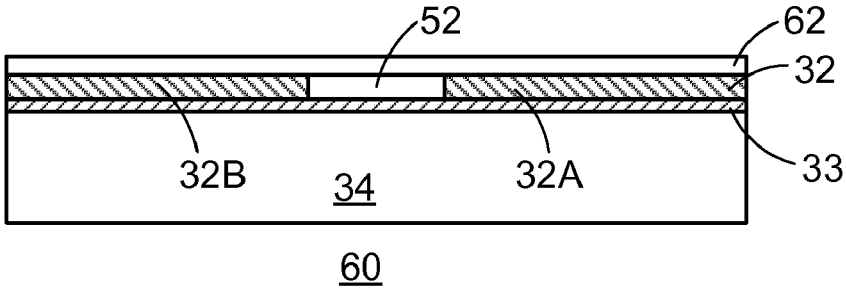
Figure 6:
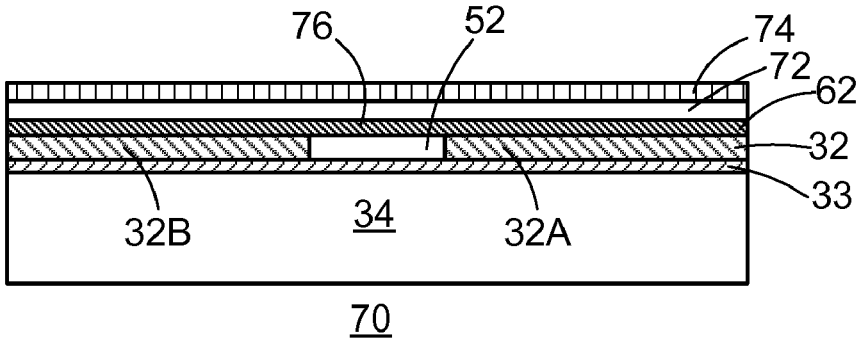

Treatment of the exposed portion 44 to transform the exposed portion 44 to be the substantially non-conductive portion 52 may be accomplished, for example in the case of the conductive layer 32 being an aluminum film, as by anodizing the aluminum film in an immersion process using sulfuric acid, phosphoric acid, chromic acid, or the like, while applying a low voltage or current to the conductive layer 32. After anodization is accomplished, steam or other heat source may be applied to the resulting substantially non-conductive portion 52 to seal the anodized layer. In addition, if desired, additional layers, such as a planarization layer 53 (FIG. 4B) may be applied to the substantially non-conductive portion 52, to eliminate voids therein, if any, before applying the resistive layer 62, as shown in FIG. 5.

In step 60 (FIG. 5), the mask layer 42 is stripped away and a resistive layer 62 is deposited adjacent (e.g., over) the conductive portions 32A and 32B and the non-conductive portion 52. The resistive layer 62 may be a layer or film of a resistive material such as tantalum-aluminum (Ta—Al), or other materials such as TaAlN, TaN, $HfB_2$, and $ZrB_2$, SiCrC or TaSiC. Typically, the layer 62 of resistive material has a thickness ranging from about 500 Angstroms to about 1600 Angstroms. The resistive layer 62 may be deposited and etched by conventional semiconductor manufacturing techniques such as sputter coating, and has a resistivity in the range of about 100 to about 2000 μOhm-cm at 500° C.

In step 70 (FIG. 6), additional protective layers, such as dielectric layer 72 and cavitation layer 74, may be applied over (e.g., deposited on) the resistive layer 62 and patterned as desired to provide a resistive fluid ejection actuator 76. The dielectric layer 72 may consist of SiN, SiON, SiC, $SiO_2$, AlN or other conventional dielectric materials such as may be deposited by CVD, PECVD or sputtering techniques and has a thickness of about 500 Angstroms to 5000 Angstroms. The cavitation layer 74 may consist of Ta, Ti or their alloys or other chemically inert layer such as may be deposited by CVD, PECVD or sputtering techniques and has a thickness of about 500 Angstroms to 5000 Angstroms.

Figure 7:
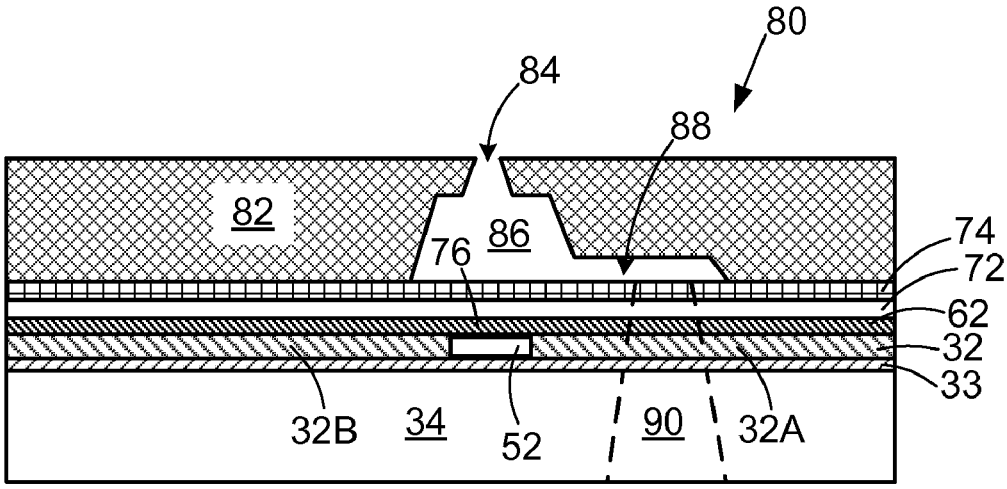
FIG. 7 is a representational cross-sectional views not to scale, of a portion of a micro-fluid ejection head containing an ejection actuator structure in accordance with the disclosure.

With reference to FIG. 7, the resistive fluid ejection actuator 76 may be incorporated into a micro-fluid ejection head 80, such as an ink jet printhead. In this regard, it will be understood that such micro-fluid ejection heads may also include a nozzle member 82 including nozzles 84 therein, a fluid chamber 86, and a fluid supply channel 88, collectively referred to as flow features. The flow features are in fluid flow communication with a source of fluid to be ejected, such as may be accomplished by having the flow features in flow communication with a feed slot 90 or the like formed in the substrate 34 for supplying fluid from a fluid supply reservoir associated with the micro-fluid ejection head and micro-fluid ejection actuators 76.

In use, the actuators 76 are electrically activated to eject fluid from the micro-fluid ejection head 80 via the nozzles 84. For example, the conductive layer 32 may be electrically connected to conductive power and ground busses to provide electrical pulses from an ejection controller in a micro-fluid ejection device, such as an inkjet printer, to the fluid ejection actuators 76. The exemplary configuration of the disclosure may advantageously provide resistive fluid ejection actuators, and ejection heads incorporating the same, wherein the ejection actuators have substantially planar topographies that avoid shortcomings associated with conventional actuators having non planar topographies. Accordingly, the resulting micro-fluid ejection heads may offer improved durability for extending the life of the micro-fluid ejection heads.

Figure 8:
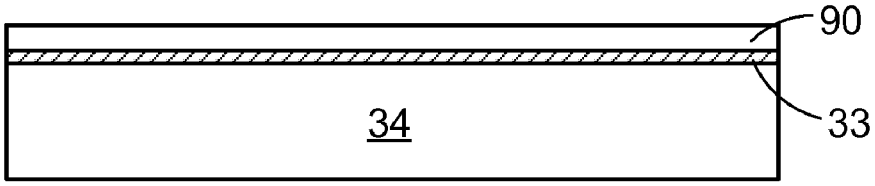
FIGS. 8-12 show steps in the manufacture of a micro-fluid ejection head structure having a substantially planar resistive fluid ejection actuator configuration according to another embodiment of the disclosure.
Figure 9:
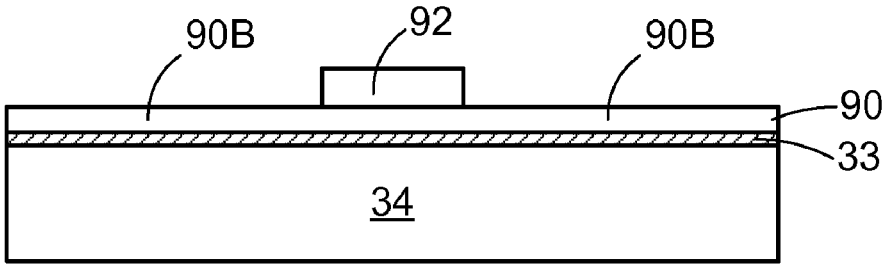

In an alternative process, illustrated in FIGS. 8-12, a non-conductive layer 90 rather than the conductive layer 32 may be deposited adjacent (e.g., on) the substrate 34 and/or insulating layer 33 (FIG. 8). As in the previous embodiment, a mask layer 92 is applied onto the non-conductive layer 90 and the mask layer 92 is developed to expose desired portions 90A and 90B of the non-conductive layer 90 intended to serve as anode and cathode conductors for a resistive fluid ejection actuator. The mask layer 92 may, for example, be a photoresist or other patterned material that is applied by conventional coating techniques, such as roll coating, blade coating, spin coating, and the like, and may be developed using conventional developing techniques to provide the desired exposed portions 90A and 90B as shown in FIG. 9. The mask layer 92 may also consist of a hard mask formed by deposition of a solid layer, such as SiN, $SiO_2$, SiON or the like, which is patterned and etched by conventional semiconductor methods to provide the desired exposed portions 90A and 90B.

Figure 10:
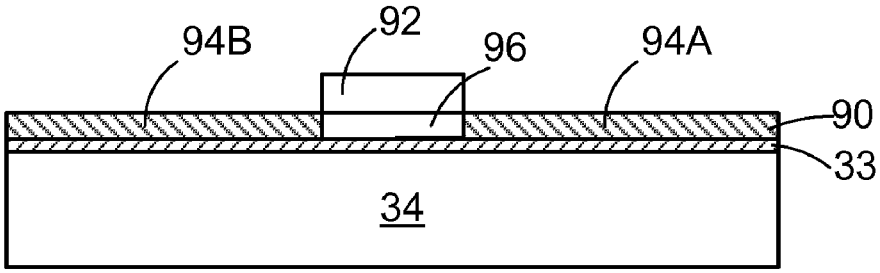

In FIG. 10, the exposed portions 90A and 90B of the non-conductive layer 90 are treated to transform the exposed portions 90A and 90B into conductive portions 94A and 94B (FIG. 11) having conductivity properties sufficiently higher than a subsequently deposited resistive layer to provide a micro-fluid ejection actuator above a non-conductive portion 96 of the layer 90. In this regard, "conductivity properties" will be understood to mean that the substantially conductive portions 94A and 94B have an electrical conductivity of at least about 50 μOhm-cm at 500° C. Thus, it will be understood that the exposed portions 90A and 90B are treated to change the exposed portions 90A and 90B from having substantially non-conductive properties to having substantially conductive properties sufficient to provide individual anode and cathodes segments 94A and 94B in the non-conductive layer 90. As in the previous embodiment, any overcoat layers applied to the non-conductive layer 90 may be substantially planar.

Treatment of the exposed portions 90A and 90B to transform the exposed portions 90A and 90B to be the substantially conductive portions 94A and 94B may be accomplished, for example by doping or diffusing conductive ions into a silicon insulator.

Figure 11:
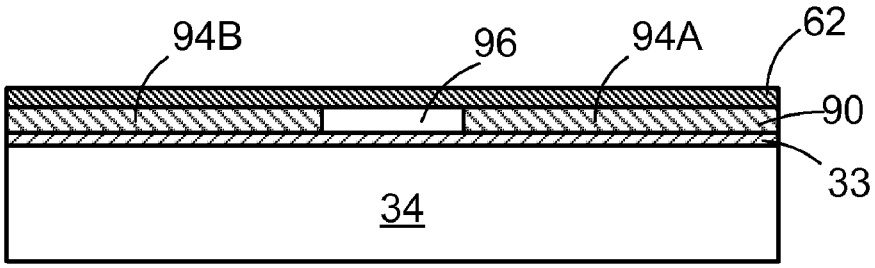

In FIG. 11, the mask layer 92 is stripped away and the resistive layer 62, as describe above, may be deposited over the conductive portions 94A and 94B and the non-conductive portion 96. As before, the resistive layer 62 may be a layer or film of a resistive material such as tantalum-aluminum (Ta—Al), or other materials such as TaAlN, TaN, $HfB_2$, and $ZrB_2$. Typically, the layer 62 of resistive material has a thickness ranging from about 800 Angstroms to about 1600 Angstroms. The resistive layer 62 may be deposited and etched by conventional semiconductor manufacturing techniques.

Figure 12:
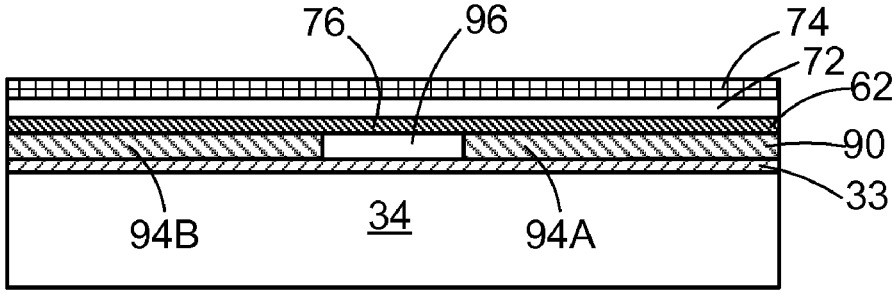

As shown in FIG. 12, additional protective layers, such as dielectric layer 72 and cavitation layer 74, may be applied to (e.g., deposited on) the resistive layer 62 and patterned as desired to provide a resistive fluid ejection actuator 76.

It is contemplated, and will be apparent to those skilled in the art from the preceding description and the accompanying drawings that modifications and/or changes may be made to the embodiments of the disclosure. For example, although the exemplary embodiments discussed above described an actuator where a resistive layer is applied over a conductive layer one of ordinary skill in the art should appreciate that the teachings of the present invention should also be applicable to embodiments where a conductive layer is applied over a resistive layer, if so desired. Accordingly, it is expressly intended that the foregoing description and the accompanying drawings are illustrative of exemplary embodiments only, not limiting thereto, and that the true spirit and scope of the present disclosure be determined by reference to the appended claims.

The invention claimed is:

1. A micro-fluid ejection head for a micro-fluid ejection device, the head comprising:

a substrate, a fluid ejection actuator disposed adjacent the substrate, and a nozzle member containing a nozzle attachment adjacent the substrate for expelling a droplet of fluid upon activation of the ejection actuator, wherein the fluid ejection actuator is provided by a conductive layer adjacent the substrate, the conductive layer having a substantially non-conductive portion made from the conductive layer, wherein the substantially non-conductive portion comprises a portion of the conductive layer that has been treated to have low conductivity properties; and a resistive layer adjacent the conductive layer, wherein the substantially non-conductive portion of the conductive layer substantially defines the fluid ejection actuator.

2. The ejection head of claim 1, wherein the conductive layer comprises a film selected from the group consisting of aluminum and tantalum films, and wherein the conductive layer has been treated by anodization to transform a portion thereof to a portion having low conductivity properties.

3. The ejection head of claim 1, wherein the substantially non-conductive portion has a resistivity of at least about 5000 μOhm-cm at 500° C.

4. The ejection head of claim 1, wherein the resistive layer overlies the conductive layer, further comprising one or more protective layers overlying the resistive layer.

5. The ejection head of claim 1, wherein the election head comprises a thermal inkjet print head.

6. The ejection head of claim 1, further comprising a layer deposited over the substantially non-conductive portion of the conductive layer and between the substantially non-conductive portion of the conductive layer and the resistive layer to provide a substantially planarized layer.

7. A resistive fluid ejection actuator, comprising:

a conductive layer adjacent a substrate, the conductive layer having a substantially non-conductive portion disposed between conductive portions, wherein the conductive layer has been treated to provide the conductive portions and the substantially non-conductive portion and wherein the conductive portions and non-conductive portion are made from a portion of the conductive layer; and a resistive layer adjacent the conductive portions and the substantially non-conductive portion.

8. The actuator of claim 1, wherein the conductive layer comprises a film selected from the group consisting of aluminum and tantalum films, and wherein a portion of the conductive layer has been treated by anodization to transform it to have low conductivity properties.

9. The actuator of claim 1, wherein the substantially non-conductive portion has a resistivity of at least about 5000 μOhm-cm at 500° C.

10. The actuator of claim 1, wherein the resistive layer overlies the conductive layer, further comprising one or more protective layers overlying the resistive layer.

* * * * *